US007850091B2

(12) United States Patent
Boecking

(10) Patent No.: US 7,850,091 B2
(45) Date of Patent: Dec. 14, 2010

(54) FUEL INJECTOR WITH DIRECTLY TRIGGERED INJECTION VALVE MEMBER

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 614 days.

(21) Appl. No.: 11/721,982

(22) PCT Filed: Nov. 24, 2005

(86) PCT No.: PCT/EP2005/056185

§ 371 (c)(1),
(2), (4) Date: Jun. 18, 2007

(87) PCT Pub. No.: WO2006/069865

PCT Pub. Date: Jul. 6, 2006

(65) Prior Publication Data

US 2009/0266921 A1 Oct. 29, 2009

(30) Foreign Application Priority Data

Dec. 23, 2004 (DE) ..... 10 2004 062 006

(51) Int. Cl.

| | |
|---|---|
| ***F02M 47/02*** | (2006.01) |
| ***F02M 41/16*** | (2006.01) |
| ***F02M 39/00*** | (2006.01) |
| ***F02M 61/20*** | (2006.01) |
| ***F02M 51/00*** | (2006.01) |
| ***B05B 1/30*** | (2006.01) |

(52) U.S. Cl. ..... 239/88; 239/96; 239/533.3; 239/533.8; 239/533.9; 239/584; 239/585.1; 123/472

(58) Field of Classification Search ..... 239/88, 239/89, 96, 533.3, 533.8, 533.9, 533.12, 239/584, 585.1, 585.5; 123/90.11, 90.12, 123/472

See application file for complete search history.

(56) References Cited

U.S. PATENT DOCUMENTS

| | | | | |
|---|---|---|---|---|
| 4,544,096 | A * | 10/1985 | Burnett | 239/92 |
| 4,909,440 | A | 3/1990 | Mitsuyasu et al. | |
| 5,697,554 | A * | 12/1997 | Auwaerter et al. | 239/88 |
| 6,168,133 | B1 * | 1/2001 | Heinz et al. | 251/57 |
| 6,298,829 | B1 | 10/2001 | Welch et al. | |
| 6,681,999 | B1 * | 1/2004 | Ruehle et al. | 239/75 |
| 6,732,949 | B1 * | 5/2004 | Harn Dorf | 239/102.2 |
| 6,820,827 | B1 * | 11/2004 | Boecking | 239/533.3 |

(Continued)

FOREIGN PATENT DOCUMENTS

| | | |
|---|---|---|
| DE | 10151688 A1 | 4/2003 |
| EP | 0324905 A1 | 7/1989 |

*Primary Examiner*—Len Tran
*Assistant Examiner*—Ryan Reis
(74) *Attorney, Agent, or Firm*—Ronald E. Greigg

(57) ABSTRACT

A fuel injector having an injector body and a fuel inlet communicates with a high-pressure fuel source outside the injector body and including an actuator received in a hollow chamber from which a high-pressure inlet extends to an injection valve member. Depending on the pressure in the first hydraulic chamber, fuel is injected into a combustion chamber of an internal combustion engine when the injection valve member lifts from a seat. The actuator acts directly upon a stepped piston which defines the first hydraulic chamber and actuates a control piston. The injection valve member is guided in the control piston.

19 Claims, 1 Drawing Sheet

U.S. PATENT DOCUMENTS

| | | | | |
|---|---|---|---|---|
| 7,100,577 | B2 * | 9/2006 | Mumford et al. | 123/498 |
| 7,455,244 | B2 * | 11/2008 | Boecking | 239/102.2 |
| 2001/0032612 | A1 | 10/2001 | Welch et al. | |
| 2001/0035163 | A1 | 11/2001 | Rahardja et al. | |
| 2001/0035164 | A1 | 11/2001 | Rahardja et al. | |
| 2004/0154562 | A1 | 8/2004 | Mattes et al. | |

* cited by examiner

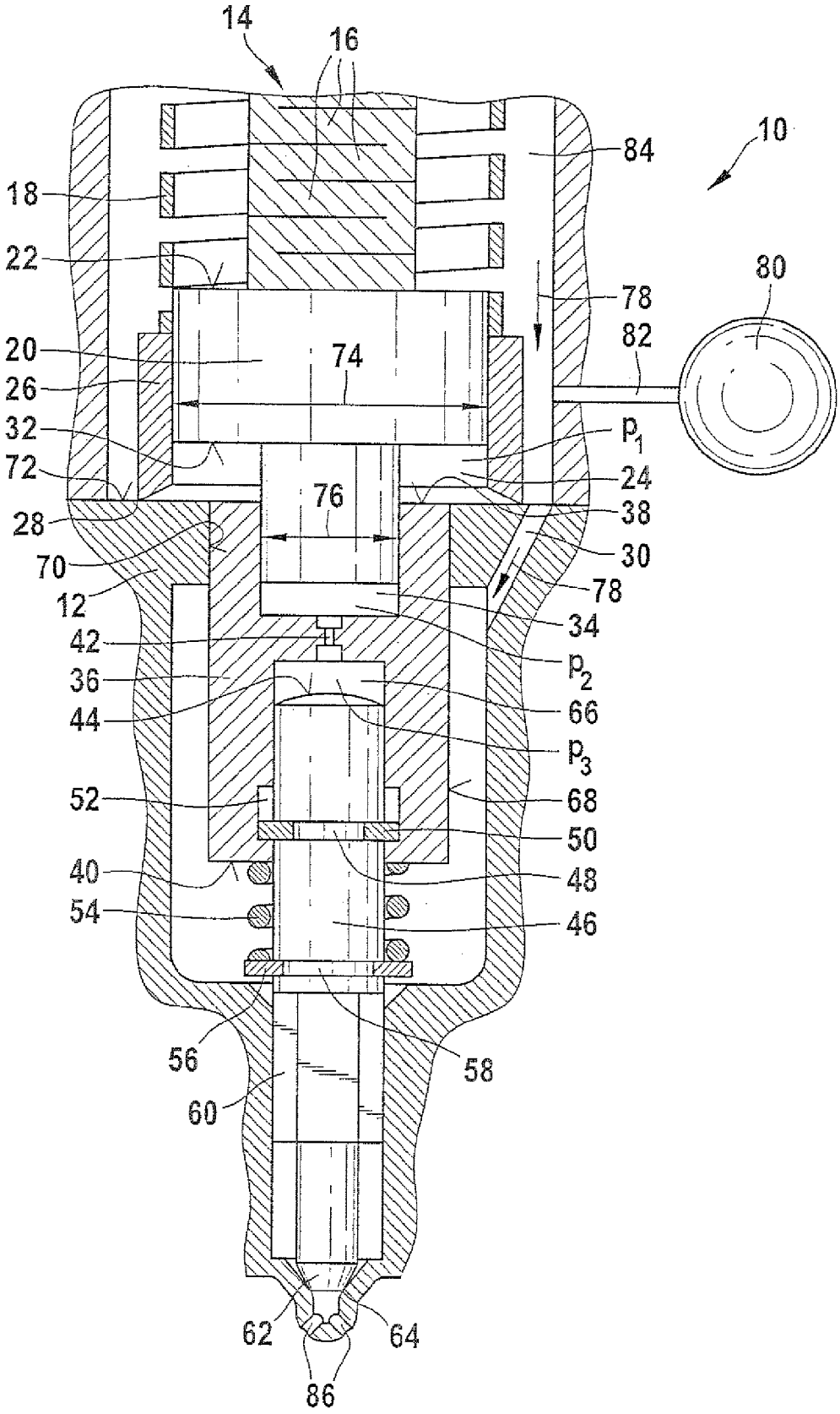
14
16
10
84
18
22
80
78
82
20
74
26
32
$p_1$
72
24
76
38
28
30
70
78
12
34
42
$p_2$
36
66
44
$p_3$
52
68
50
40
48
54
46
56
58
60
62
64
86

FUEL INJECTOR WITH DIRECTLY TRIGGERED INJECTION VALVE MEMBER

CROSS-REFERENCE TO RELATED APPLICATION

This application is a 35 USC 371 application of PCT/EP 2005/056185 filed on Nov. 24, 2005.

BACKGROUND OF THE INVENTION

1. Field of the Invention

In internal combustion engines, fuel injectors are used, with which fuel that is at high pressure is injected into the combustion chambers of the engine. Such fuel injectors, which are used for instance in self-igniting internal combustion engines, include an injector housing, which is in communication with a high-pressure source located outside the fuel injector, such as a high-pressure collection chamber (common rail). The high-pressure collection chamber is supplied in turn with fuel that is at high pressure via a high-pressure pump.

2. Prior Art

German Patent Disclosure 10 2004 037 125.3 relates to a common rail injector including an injector housing with a fuel inlet, which is in communication with a central high-pressure fuel source outside the injector housing and with a pressure chamber inside the injector housing. From the latter, as a function of the pressure in a nozzle needle control chamber, fuel subjected to high pressure is injected into a combustion chamber of an internal combustion engine when a nozzle needle lifts from its seat. The nozzle needle control chamber is in communication with an actuator pressure chamber that is defined by an actuator, which is preferably a piezoelectric actuator. Between the actuator pressure chamber and the nozzle needle control chamber, a throttle device is disposed, which upon evacuation of the nozzle needle control chamber makes possible a smaller flow rate from the nozzle needle control chamber into the actuator pressure chamber than upon filling of the nozzle needle control chamber from the actuator pressure chamber into the nozzle needle control chamber. The throttle device is designed and disposed such that it develops its throttling action only upon evacuation of the nozzle needle control chamber, while upon filling of the nozzle needle control chamber it does not develop any throttling action but instead assures an unhindered flow through of fuel. The throttle device includes a throttle piston, which has a through hole that makes a throttled flow through of fuel from the nozzle needle control chamber into the actuator pressure chamber possible.

In fuel injectors in which the pressure in a control chamber is controlled by an actuator, such as a piezoelectric actuator, the term used is also direct control, or in other words a direct control of the injection valve member, which for example may be embodied as a nozzle needle.

SUMMARY AND ADVANTAGES OF THE INVENTION

The fuel injector proposed in accordance with the invention is distinguished by a very simple, compact construction. In particular, by the use of a piston that can be embodied in steplike form (stepped piston) associated with an actuator, the opening of the injection valve member is achieved in a very simple way.

The actuator, in particular a piezoelectric actuator, is received in a hollow chamber, into which a line from a high-pressure collection chamber (common rail) discharges. The stepped piston that can be acted upon directly by the actuator is on the one hand surrounded by a sleeve defining a first hydraulic chamber; on the other hand, part of the piston that can be embodied in steplike form is guided in a control piston. The stepped piston, with an annular face at the transition in diameter, defines a first hydraulic chamber, and with an end face embodied with a lesser diameter, it defines a second hydraulic chamber inside the control piston. Inside the control piston, a further, third hydraulic chamber is embodied; the second and third hydraulic chambers communicate hydraulically via a conduit that contains a throttle restriction. Also located in the control piston is a recess, in which a driver, which is received on the circumference of the injection valve member, is movable. Via a compression spring, braced on the lower face end of the control piston, the injection valve member is placed relative to the control piston such that the mechanical driver, which can be embodied for instance as a disk or ring, always rests on a stop of the recess inside the control piston. The actuator which is received in the hollow chamber of the fuel injector is triggered inversely. Upon an inverse triggering, current is supplied to the piezoelectric actuator, and the injection valve member is in its closed state. The injection openings embodied on the combustion chamber end of the fuel injector are closed by the injection valve member and is placed in its seat. For opening of the injection valve member, the piezoelectric actuator is switched to a currentless state, so that the length of the piezoelectric crystal stack is reduced. This leads to a pressure relief of the first hydraulic chamber, which in turn leads to the opening of the injection valve member.

Upon pressure relief of the first hydraulic chamber, the control piston moves into this hydraulic chamber. Simultaneously, by means of the piston, the second hydraulic chamber inside the control piston is relieved, which thus reinforces the opening of the injection valve member. Upon pressure relief of the second hydraulic chamber, the third hydraulic chamber is also pressure-relieved, since it communicates with the second hydraulic chamber through a conduit. The control piston communicates via the mechanical driver with the injection valve member, so that upon pressure relief of the first hydraulic chamber by upward motion of the stepped piston as the control piston is moving into the first hydraulic chamber, the injection valve member is pulled upward. The opening of the nozzle needle is thus based on two effects, namely the pressure relief of the first hydraulic chamber upon upward motion of the stepped piston, and the associated pulling upward of the injection valve member that can be embodied as a nozzle needle by the mechanical driver and by the pressure relief of the two hydraulic chambers embodied in the control piston. Because of the pressure reduction in the two hydraulic chambers embodied in the control piston, or in other words in the second and third hydraulic chambers, a delayed pressure reduction takes place, so that the injection valve member lifts from the mechanical driver and automatically opens wider, without requiring that the piezoelectric actuator be moved farther.

The way proposed by the invention of attaining the above object is distinguished by its simple construction and by the fact that the stepped piston not only actuates the control piston into which the injection valve member is guided but also assures a pressure reduction or pressure increase in the two communicating second and third hydraulic chambers. Since the second hydraulic chamber and the third hydraulic chamber are coupled together via a conduit that contains a throttle restriction, the pressure reduction in the third hydraulic chamber takes place in delayed fashion, compared with the pressure reduction in the second hydraulic chamber, so that the possibility exists that the injection valve member is capable of moving relative to the control piston and in particular automatically opens wider upon the opening event without requiring that the actuator be moved farther.

BRIEF DESCRIPTION OF THE DRAWING

The invention will be described in further detail below, in conjunction with the sole drawing FIGURE which shows a cross section through the fuel injector proposed according to the invention.

The sole FIGURE shows a cross section through the fuel injector proposed according to the invention.

DESCRIPTION OF THE PREFERRED EMBODIMENTS

A fuel injector 10 according to the invention includes an injector body 12, in which a hollow chamber 84 is embodied. Discharging into the hollow chamber 84 is a line 82, which extends between the injector body 12 of the fuel injector 10 and a high-pressure collection chamber 80. Instead of the high-pressure collection chamber 80, a different high-pressure source could be used in order to supply the hollow chamber 84 of the fuel injector 10 with fuel that is at high pressure. An actuator 14 is received inside the hollow chamber 84, in the upper region of the fuel injector 10. The actuator 14 is preferably a piezoelectric actuator, which includes a number of piezoelectric crystals 16 which are disposed in stacked fashion one above the other. Via an electrical connection not shown in the drawing, the actuator 14 is connected to a voltage source. Upon subjection of the actuator 14 to a voltage, the individual piezoelectric crystals of a piezoelectric crystal stack lengthen; upon termination of the application of a voltage to the piezoelectric crystal stack of the actuator 14, the piezoelectric crystal stack resumes its original length. The piezoelectric crystal stack 16 of the actuator 14 is surrounded by a spring 18 embodied as an annular spring. Both the spring 18 and the piezoelectric crystal stack 16 rest on an end face 22 of a stepped piston 20.

The piston 20 likewise received in the hollow chamber 84 is surrounded by a control chamber sleeve 26. On the control chamber sleeve 26 there is a bite edge 28, with which the control chamber sleeve 26, acted upon by the spring 18, is positioned on a plane face 72 of the injector body 12. The stepped piston 20 includes a first region, which is embodied with a first diameter 74, and a second region, which is embodied with a second diameter 76. The first diameter 74 is dimensioned as larger than the second diameter 76. Because of the diameter difference with which the two portions of the piston 20 are dimensioned, a first hydraulic chamber 24 is formed inside the control chamber sleeve 26 that surrounds the piston 20. By means of this chamber, a first face end 38 of a control piston 36 can be acted upon.

On the piston 20, because of the difference in diameter between the first diameter 74 and the second diameter 76, an annular face identified by reference numeral 32 develops, which defines the first hydraulic chamber 24 that is furthermore defined by the inner circumferential surface of the control chamber sleeve 26, by a first face end 38 of the control piston 36, and by parts of the plane face 72 of the injector body 12.

The region of the stepped piston 20 embodied with the second diameter 76 acts upon a second hydraulic chamber 34, which is embodied in the control piston 36. The second hydraulic chamber 34 communicates hydraulically with a third hydraulic chamber 66 inside the control piston 36 via a conduit containing a throttle restriction 42.

An end face 44 of an injection valve member 46 protrudes into the third hydraulic chamber 66. The injection valve member 46 is guided in the control piston 36. In the control piston 36, a hollow chamber 52 is embodied, inside of which a mechanical driver 50 is capable of moving. The mechanical driver 50 may for example be embodied as a ring or as a disk, which is received in an annular groove 48 on the circumference of the injection valve member 46.

In the view shown in the drawing, the mechanical driver 50 rests on a stop that defines one end of the hollow chamber 52. In this position, the mechanical driver 50 is retained as a result of the fact that a spring 54 has one end braced on a second face end 40 of the control piston 36, and its second end braced on a support disk 56, provided in a groove 58, on the outer circumference of the injection valve member 46 and positions the injection valve member 46 relative to the control piston 36. For the sake of completeness, it will be noted that a first face end 38 of the control piston 36 can be acted upon by the first hydraulic chamber 24.

The control piston 36 is received in a further hollow chamber in the interior of the injector body 12, into which chamber fuel enters from the hollow chamber 84 via a high-pressure inlet 30. The pressure level inside the hollow chamber 84, the first hydraulic chamber 24, and the hollow chamber surrounding the control piston 36 is designated $p_1$. The respective pressure prevailing in the second hydraulic chamber 36 is designated $p_2$, while the pressure prevailing in the third hydraulic chamber 66 is designated $p_3$.

Below the support disk 56 on the outside circumference of the injection valve member 46, there are flat faces 60 by way of which the fuel contained in the hollow chamber that surrounds the control piston 36 flows to a nozzle tip 62 and, via injection openings 86, can be injected into the combustion chamber of an internal combustion engine, if the injection openings are opened by the nozzle tip 62. In the view shown in the drawing, the nozzle tip 62 is located in a nozzle seat 64, so that the injection of fuel into the combustion chamber of the engine is prevented.

The control piston 36 has a jacket face 68 surrounded by fuel and is guided in a guide 70 that is embodied in the injector body 12. Reference numeral 78 represents the fuel flow which develops from the hollow chamber 84, in which the actuator 14 is received, via the high-pressure inlet 30 into the hollow chamber in which the control piston 36 is movably guided.

The mode of operation of the fuel injector proposed according to the invention is as follows:

Upon inverse triggering of the actuator 14, the injection valve member 46 is in its closing position when the actuator 14 is supplied with current.

In the view shown in the drawing, the injection valve member 46 is in its closing position. In this state, the injection openings 86 into the combustion chamber of an internal combustion engine are closed; the nozzle tip 62 is located in the nozzle seat 64. To effect the closure of the injection valve member 46, the actuator 14 is connected to a voltage source, so that the piezoelectric crystal stack 16 lengthens in accordance with the number of piezoelectric crystals present in it, and the stepped piston 20 is subjected to pressure. As a result, the fuel volume present in the first hydraulic chamber 24 is compressed, and the first face end 38 of the control piston 36 is acted upon. Moreover, because of the compression of the fuel volume in the second hydraulic chamber 34, the pressure in the third hydraulic chamber 66 also increases, so that the control piston 36 and the injection valve member 46 guided in it are placed in the nozzle seat 64. No fuel injection occurs.

The opening of the injection valve member 46 is effected by canceling the subjection of the actuator 14 to voltage. The individual piezoelectric crystals inside the piezoelectric crystal stack 16 resume their original shape upon cancellation of the subjection of the actuator 14 to voltage; that is, the stepped piston 20 moves upward, thus causing a pressure relief of the first hydraulic chamber 24. Because of the pressure relief of the first hydraulic chamber 24, the control piston 36 moves with its first face end 38 into the first hydraulic chamber 24. During the vertical motion of the control piston 36 toward the first hydraulic chamber 24, the mechanical driver 50, received on the circumference of the injection valve member 46, rests on the lower stop of the hollow chamber 52. If the control piston 36 is moving in the vertical direction upward, the injection valve member 46 is pulled upward by the mechanical driver 50 surrounded by the control piston 36, and the nozzle tip 62 of the injection valve member 46 is moved out of its nozzle seat 64, so that the injection openings B6 on the combustion chamber end of the fuel injector 10 are opened, and an injection of fuel into the combustion chamber takes place. Upon opening of the nozzle seat 64, or in other words a vertical motion of the injection valve member 46 out of the nozzle seat 64 upon an upward motion of the control piston 36, the second hydraulic chamber 34 is furthermore pressure-relieved. This is due to the fact that upon cancellation of the subjection of the actuator 14 to voltage, the region of the stepped piston 20 that is embodied with the second diameter 76 moves out of the second hydraulic chamber 34. Since the second hydraulic chamber 34 and the third hydraulic chamber 66 communicate hydraulically with one another via a conduit that contains a throttle restriction 42, a delayed pressure reduction ensues in the third hydraulic chamber 66 upon pressure relief of the second hydraulic chamber 34. The delayed pressure reduction in the third hydraulic chamber 66 realized in this way causes the injection valve member 46 to move relative to the control piston 36. In this case, the mechanical driver 50 lifts from the lower stop of the hollow chamber 52. The length of the relative motion that occurs between the control piston 36 and the injection valve member 46 depends on the length of the hollow chamber 52 in the axial direction of the injection valve member 46. Because of the length of the stroke that the mechanical driver 50, locked onto the injection valve member 46, is capable of executing in the hollow chamber 52, a relative motion of the injection valve member 46 relative to the control piston 36 is possible upon opening, and an automatic opening of the injection valve member 46 is attainable without requiring that the actuator 14 be moved farther.

By the dimensioning of the particular throttle restriction 42 that is provided in the conduit between the second and third hydraulic chambers 34, 66, the delay of the pressure reduction in the third hydraulic chamber 66 can be adjusted.

With the embodiment proposed by the invention, it can be attained that upon the opening of the injection valve member 46 the opening is effected on the one hand by the pressure reduction in the first hydraulic chamber 24 and by the movement of the control piston 36 into it; because of the mechanical driver 50, the injection valve member 46 is pulled upward by the control piston 36, and because of the delayed pressure reduction in the third hydraulic chamber 66, the opening behavior of the fuel injector of the injection valve member 46 can be optimally adapted to the load state of the engine. The construction shown in the drawing of the fuel injector 10 is striking in its simplicity, since the injection valve member 46 that can preferably be embodied as a nozzle needle and the stepped piston 20 are both guided in one and the same control piston 36. The control piston 36 is in turn centered and guided with its jacket face 68 in the guide 70 of the injector body 12.

The filling of the first hydraulic chamber 24 inside the fuel injector 10 takes place via gap flows between the control chamber sleeve 26 and the stepped piston 20 since the hollow chamber 84 in which the aforementioned components are received is subjected to fuel that is at high pressure. The control piston 36 is guided by the guide face 70 inside the injector body 12 of the fuel injector 10. The filling of the second hydraulic chamber 34 and the third hydraulic chamber 66 is effected via the hollow chamber, embodied in the lower region of the fuel injector 10, to which fuel that is at high pressure flows in the direction of the arrow 78 from the hollow chamber 84. Via the gaps between the injection valve member 46 and the control piston 36 and via the conduit that contains the throttle restriction 42, the hydraulic chambers 34 and 66, respectively, are subjected to fuel.

By means of the spring element 54, which extends between the second face end 40 of the control piston 36 and the support disk 56 of the injection valve member 46, an outset position of the components 36 and 46 that are movable relative to one another is defined. By means of the spring element 54, the mechanical driver 50, mounted on the circumference of the injection valve member 46 is always placed against the lower stop of the hollow chamber 52 inside the control piston 36. Since the hydraulically effective area, in accordance with the second diameter 76 of the stepped piston 20 is less than the hydraulically effective area of the stepped piston 20, or n other words the inner annular face 32 of the stepped piston 20 in accordance with the first diameter 74 and the second diameter 76, the control piston 36 initially executes an opening motion and carries the injection valve member 46 along with it via the mechanical driver 50. Upon an ensuing pressure relief of the third hydraulic chamber 66, the mechanical driver 50 lifts from its stop, shown in the drawing, on the lower end of the control piston 36, so that a wider opening of the injection valve member 46 takes place.

The foregoing relates to a preferred exemplary embodiment of the invention, it being understood that other variants and embodiments thereof are possible within the spirit and scope of the invention, the latter being defined by the appended claims.

The invention claimed is:

1. In a fuel injector, having an injector body, having a fuel inlet which is in communication with a high-pressure fuel source outside the injector body, having an actuator received in a hollow chamber from which hollow chamber a high-pressure inlet extends to an injection valve member, and as a function of the pressure in a first hydraulic chamber, fuel is injected into the combustion chamber of an internal combustion engine when the injection valve member lifts out of a seat, the improvement comprising a stepped piston acted directly on by the actuator, and a control piston which moves relative to the stepped piston and in which the injection valve member is guided, a step of the stepped piston defining the first hydraulic chamber on a first end of the first hydraulic chamber and an end face of the control piston defining the first hydraulic chamber on a second end of the first hydraulic chamber, the first hydraulic chamber acting on the end face of the control piston, the stepped piston acting on a second hydraulic chamber, which second hydraulic chamber is embodied in the control piston and which communicates hydraulically with a third hydraulic chamber disposed in the control piston, wherein an end face of the injection valve member protrudes into the third hydraulic chamber, and wherein the stepped piston is embodied with a first diameter and a second diameter, the first diameter exceeds the second diameter, the first diameter is acted on by the actuator, and the second diameter acts on the second hydraulic chamber.

2. The fuel injector as defined by claim 1, further comprising an annular face on the step of the stepped piston defining the first hydraulic chamber, and a sleeve embracing the annular face.

3. The fuel injector as defined by claim 1, wherein the control piston comprises both the second hydraulic chamber and the third hydraulic chamber which communicate hydraulically with one another, and wherein the control piston is guided in a guide of the injector body.

4. The fuel injector as defined by claim 1, further comprises a mechanical driver disposed on the injection valve member and guided in a hollow chamber of the control piston movably between a first and a second stroke stop.

5. The fuel injector as defined by claim 1, further comprising a spring element disposed between a face end of the control piston and the injection valve member, the spring biasing the injection valve member into a defined outset position relative to the control piston.

6. The fuel injector as defined by claim 1, wherein the control piston comprises both the second hydraulic chamber and the third hydraulic chamber which communicate hydraulically with one another, and wherein the control piston is guided in a guide of the injector body, and wherein upon subjection of the actuator to voltage, by simultaneous subjection of the first hydraulic chamber and the second hydraulic chamber to pressure via the stepped piston the injection valve member guided in the control piston is pressed into its seat.

7. The fuel injector as defined by claim 1, the control piston comprises both the second hydraulic chamber and the third hydraulic chamber which communicate hydraulically with one another, and wherein the control piston is guided in a guide of the injector body, and wherein upon termination of subjection of the actuator to voltage, the first and second hydraulic chambers are simultaneously pressure-relieved and the third hydraulic chamber is pressure-relieved in delayed fashion, and wherein the control piston embraces a mechanical driver to move the injection valve member out of its seat.

8. The fuel injector as defined by claim 7, wherein the mechanical driver is disposed in a hollow chamber in the control piston, and wherein upon a delayed pressure relief of the third hydraulic chamber, the injection valve member automatically opens wider in accordance with the length of the hollow chamber.

9. In a fuel injector, having an injector body, having a fuel inlet which is in communication with a high-pressure fuel source outside the injector body, having an actuator received in a hollow chamber from which hollow chamber a high-pressure inlet extends to an injection valve member, and as a function of the pressure in a first hydraulic chamber, fuel is injected into the combustion chamber of an internal combustion engine when the injection valve member lifts out of a seat, the improvement comprising a stepped piston acted directly on by the actuator, and a control piston which moves relative to the stepped piston and in which the injection valve member is guided, a step of the stepped piston defining the first hydraulic chamber on a first end of the first hydraulic chamber and an end face of the control piston defining the first hydraulic chamber on a second end of the first hydraulic chamber, the first hydraulic chamber acting on the end face of the control piston, the stepped piston acting on a second hydraulic chamber, which second hydraulic chamber is embodied in the control piston and which communicates hydraulically with a third hydraulic chamber disposed in the control piston, wherein an end face of the injection valve member protrudes into the third hydraulic chamber, wherein the control piston comprises both the second hydraulic chamber and the third hydraulic chamber which communicate hydraulically with one another, and wherein the control piston is guided in a guide of the injector body, and wherein the second hydraulic chamber and the third hydraulic chamber communicate with one another via a conduit containing a throttle restriction.

10. The fuel injector as defined by claim 2, further comprising a plane face embodied on the injector body, and wherein the sleeve surrounding the stepped piston is braced with a bite edge which rests on the plane face.

11. The fuel injector as defined by claim 1, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

12. The fuel injector as defined by claim 2, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

13. The fuel injector as defined by claim 1, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

14. The fuel injector as defined by claim 3, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

15. The fuel injector as defined by claim 4, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

16. The fuel injector as defined by claim 5, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

17. The fuel injector as defined by claim 6, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

18. The fuel injector as defined by claim 7, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

19. The fuel injector as defined by claim 8, wherein opening of the injection valve member upon cancellation of subjection of the actuator to voltage is effected by means of pressure relief of the first hydraulic chamber, upon slaving of the injection valve member by the control piston, and by delayed pressure relief of the third hydraulic chamber in the control piston, while the injection valve member automatically moves in an opening direction relative to the control piston.

* * * * *